United States Patent [19]

Bruderle et al.

[11] Patent Number: 4,472,089

[45] Date of Patent: Sep. 18, 1984

[54] CHANNEL CONSTRUCTION MACHINERY HAVING A LEVELLING AND MATERIAL LINING APPLICATION ATTACHMENT

[75] Inventors: Egon Bruderle, Zweibrucken; Willibald Wannemacher, Bierbach, both of Fed. Rep. of Germany

[73] Assignee: Mannesmann Aktiengesellschaft, Dusseldorf, Fed. Rep. of Germany

[21] Appl. No.: 400,248

[22] Filed: Jul. 21, 1982

[30] Foreign Application Priority Data

Jul. 23, 1981 [DE] Fed. Rep. of Germany ..... 3130448

[51] Int. Cl.[3] ..... E02F 5/04

[52] U.S. Cl. ..... 405/268; 37/80 A; 404/114; 405/303

[58] Field of Search ..... 405/268, 303; 404/114; 37/96, 97, 80 A, DIG. 16, 110, 108 R; 172/119, 33

[56] References Cited

U.S. PATENT DOCUMENTS

| | | | |
|---|---|---|---|
| 2,138,828 | 12/1938 | Barber | 404/114 X |
| 2,169,468 | 8/1939 | McDougall et al. | 37/80 A X |
| 2,303,336 | 12/1942 | Day | 404/114 |
| 2,430,816 | 11/1947 | Jackson | 404/114 |
| 2,975,602 | 3/1961 | Stromberg | 405/268 |
| 3,161,116 | 12/1964 | Larsen et al. | 404/114 X |
| 3,328,902 | 7/1967 | Hanson | 37/81 |
| 3,850,541 | 11/1974 | Baillet et al. | 404/114 |
| 3,922,802 | 12/1975 | James | 37/97 |

FOREIGN PATENT DOCUMENTS

| | | |
|---|---|---|
| 2158818 | 5/1973 | Fed. Rep. of Germany . |
| 325376 | 12/1957 | Switzerland . |

OTHER PUBLICATIONS

Article: "Modern Machines for Slope and Channel Construction".

*Primary Examiner*—Dennis L. Taylor

*Attorney, Agent, or Firm*—Mandeville and Schweitzer

[57] ABSTRACT

Channel construction machinery is provided with a levelling and material lining application attachment to thus provide a continuous mode of channel construction operation in either the longitudinal or transverse direction of operation with respect to the longitudinal axis of the channel. The levelling and/or lining attachment is provided with at least one shaft which is mounted and driven so as to rotate. The length of the shaft is proportioned to the length of the embankment section to be worked on. Located about the circumference of the shaft are blade-like elements, whose surfaces are directed at an angle to the axis of the shaft. The shafts and angularly directed blades are mounted on implement carriers of the channel construction machine in a manner such that they oscillate by being connected to vibration actuators. The implement carriers, however, attached to the frame of the apparatus are isolated from the vibrations of the vibrator by damping elements. In the preferred embodiment of the invention, the blade-like elements are linked together and fixedly mounted as a helix surrounding the rotating and oscillating shaft.

8 Claims, 6 Drawing Figures

CHANNEL CONSTRUCTION MACHINERY HAVING A LEVELLING AND MATERIAL LINING APPLICATION ATTACHMENT

BACKGROUND OF THE INVENTION AND DESCRIPTION OF THE PRIOR ART

The present invention relates to channel construction machinery having levelling and material lining application attachments for providing continuous channel construction operations either parallel or at right angles to the longitudinal axis of the channel. When the channel construction equipment travels in the direction of the longitudinal axis of the channel with its extending arms working on the sloped embankments, the apparatus is considered a longitudinal channel construction apparatus. On the other hand, if the equipment travels up and down the sloped embankments, then the apparatus is considered a transverse channel construction apparatus.

On inclined embankments, in the construction of water channels or irrigations channels, according to the longitudinal channel construction process, compacting of the applied channel lining, made from freshly laid concrete, has been performed by using internal vibrators which require vibration chambers. These chambers are arranged in a stepwise fashion and prevent the plasticized concrete from flowing down to the bottom of the channel. Such known channel lining accessories used on the apparatus frames of channel construction machinery are provided with independent vibration elements, which operate in vibration chambers themselves bounded on all sides and immersed in the lining material. The sliding framework which slides over the concrete to form a smooth and level lining is placed in direct contact with the vibrating chamber to thereby make a continuous material lining placement process possible.

Associated with this known material applying accessory is a handling device which is adapted to load the lining material to the vibration chamber from above. Basically, however, such vibration chambers of the prior art are not very accessible, are relatively complicated in their construction and, in particular, are not especially inexpensive to manufacture. In addition, the present operational and maintenance requirements of such vibration chambers are not particularly advantageous.

The prior art lining accessory for channel construction machinery is, moreover, useful strictly for the purpose of lining water channels or irrigation channels. Other tools must now be used for the purpose of levelling the embankment walls to which the lining is applied.

According to the state of the art, levelling accessories, which are incorporated onto implement carriers supported on the machine frame, are completely differently constructed than the lining material placement accessories. Consequently, channel construction machinery is separately built as levelling machinery or as lining machinery with both being present for a complete construction operation or as a single piece of machinery in which separate levelling and lining accessories are used. (See, for example, "Modern Machines for Embankment and Channel Construction" BMT, June 6, 1978, pages 317 ff.)

It is a specific object of the present invention to improve the prior art known channel construction machinery with respect to the present levelling and lining accessories. Moreover, an object of the present invention is to do so in an extremely simple manner.

This objective is accomplished in the present invention by using a single levelling and/or lining attachment which is provided with at least one rotating shaft. The shaft is mounted and driven so as to rotate and is proportioned in length to the length of the embankment section to be worked on. At the circumference of the shaft, i.e., along its outside cylindrical wall, blade-like elements are attached. Blade surfaces of the blade-like elements are directed at an angle to the longitudinal axis of the shaft. The shaft is mounted on an implement carrier in such a manner that it oscillates by being connected to a vibration drive. The implement carrier, however, is mechanically isolated from the vibrations and the oscillations. Channel construction machinery, so designed, is considerably simplified since the processes of levelling and lining are now substantially integrated. During levelling, the excess loosened earth material which may be desirously transported to another location is conveyed in the desired direction. During the material lining process, the existing blade-like elements control the transport of lining material and provide a support function for the previously used partitions of the vibration chamber. Excess lining material is transported in the direction of conveying and to places where lining material is lacking or, if sufficient lining material has been supplied, the excess material is transported further in the sense of an accelerated mode of operation. The amount of material transported is matched to the rate of travel of the machinery.

The structure of the inventive attachment is moreover very simple and can be manufactured particularly inexpensively. The handling of the material is simplified since the rotating shaft is open towards one side. In addition, the blade-like elements can easily be inspected by the simplified construction of the present invention. The easier access to the mechanical elements is a further advantage of the invention. The good, overall view also has a favorable effect on the operating and maintenance requirements. The inventive attachment can be used transversely, as well as at an angle or parallel to the longitudinal axis of the channel depending on the category of apparatus used in the channel construction operation. The motions of the inventive attachment, disclosed herein, can be significantly controlled if, according to a further characteristic of the invention, the blade-like elements can be individually adjusted with respect to the angular relationship between them and the longitudinal axis of the rotating shaft.

A further, simplified development of the present invention is proposed, according to which the blade-like elements are linked together and mounted, in a fixed fashion, as a helix of connected blades surrounding the shaft. In this case, the attachment resembles a worm-type shaft, whose rotational motion assists in conveying the excess earth material or the lining material transversely with respect to the longitudinal axis of the channel. The circumferential line defined by the rotating shaft, which extends parallel to the axis of the rotating shaft, determines the applied thickness of the layer of lining. Greater lengths of embankment walls of large width channels are handled by connecting several of such rotating shafts together elastically and detachably at their connecting ends.

The shaft drive mechanism is mechanically connected to the shafts such that the rotary actuators for the shafts are connected to the exterior ends of the shafts, and located on the berm of the channel. According to a feature of the present invention, each rotating shaft is mounted on a separate and independent implement carrier. The implement carriers, in each case, are supported by the machine frame in such a way as to be isolated from the oscillations directed to the shaft. The present invention replaces former vibration attachments since the vibration drive is now connected between the machine frame and the implement carrier. This vibration drive alters the previous vibration attachments since the vibration drive is now provided on the implement carrier and transfers the axially directed oscillations to the shaft mounted on the implement carrier.

In this connection, it is furthermore advantageous to attach the implement carriers to the machine frame with the interpositioning of damping elements. In this manner, otherwise mechanically harmful oscillations are isolated away from the frame of the machine.

A further improvement of the present invention consists in surrounding the shaft, having the blade-like elements, with a housing and the side walls or housing extension surfaces of the housing forming a sliding formwork for smoothing the just-laid lining material.

Several examples of the operation of the invention are shown in the drawings and are described in greater detail in the following.

DETAILED DESCRIPTION OF THE DRAWINGS

Figure 1:
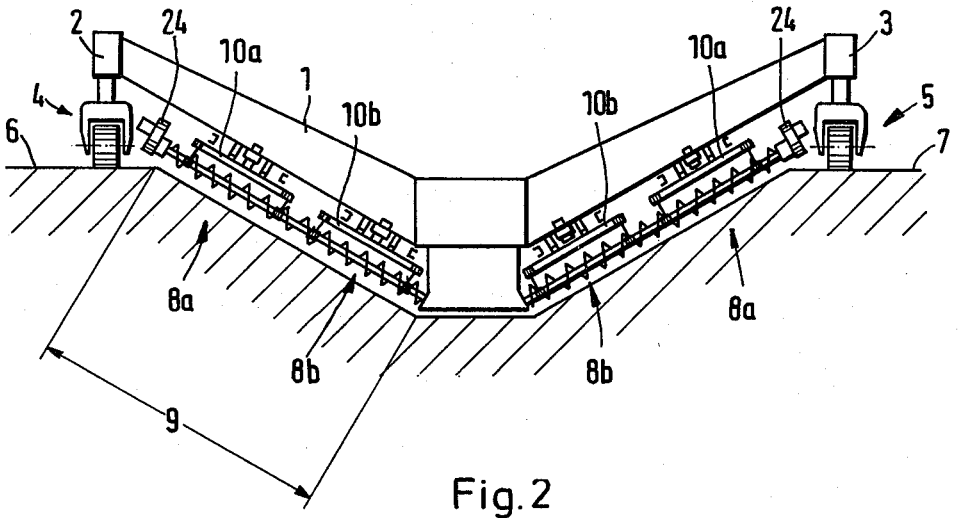
FIG. 1 is a vertical cross sectional view taken across the longitudinal axis of the channel and showing the inventive channel construction machinery in a frontal view. The channel construction machinery shown in this figure is of the longitudinal channel construction type.
Figure 2:
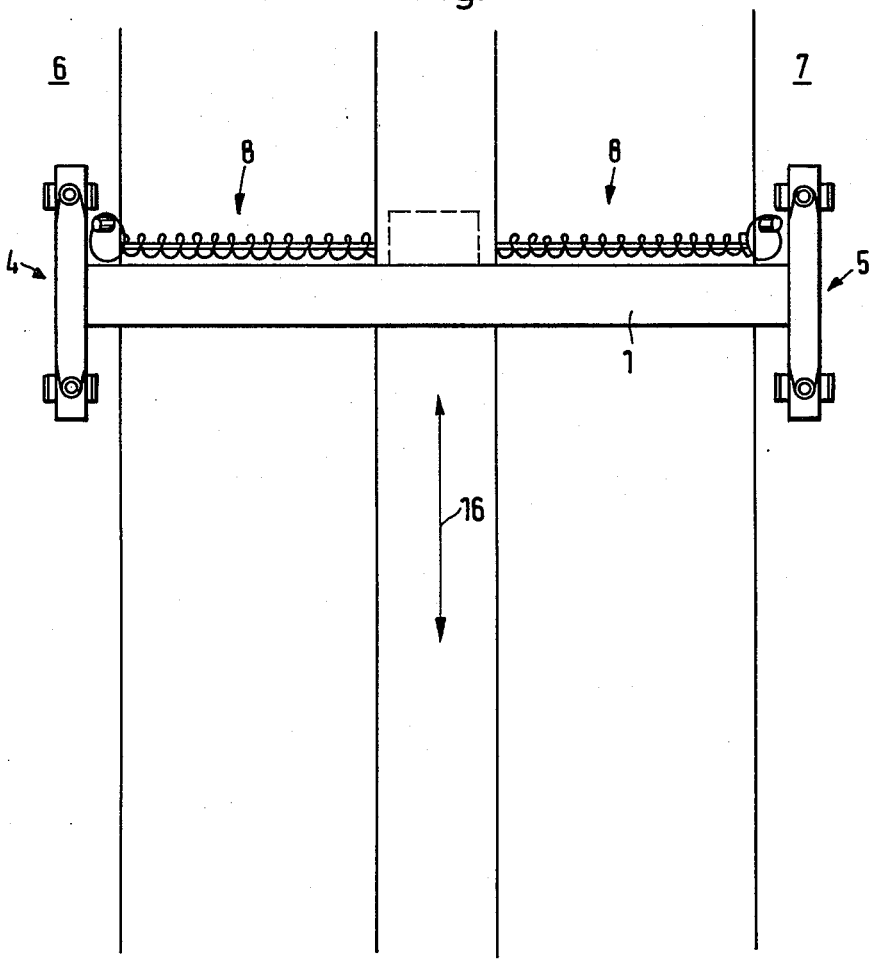
FIG. 2 is a top plan view of the channel and machinery shown in FIG. 1.
Figure 3:
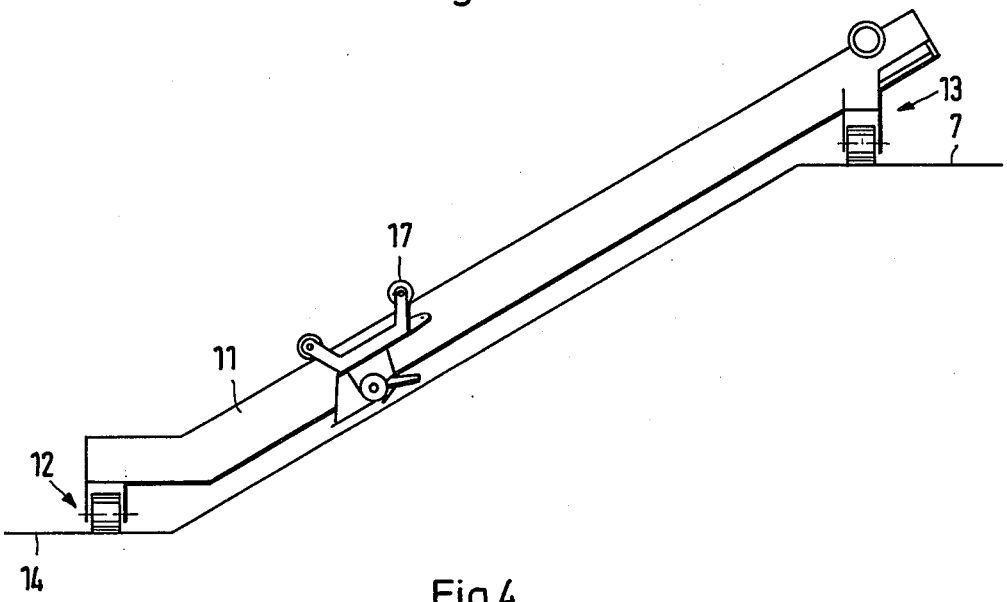
FIG. 3 is a vertical cross sectional view taken across the longitudinal axis of the channel with the inventive channel construction machinery being used on the transverse channel machinery, i.e., embankment travelling machinery, (in contrast to longitudinal travelling machinery).
Figure 4:
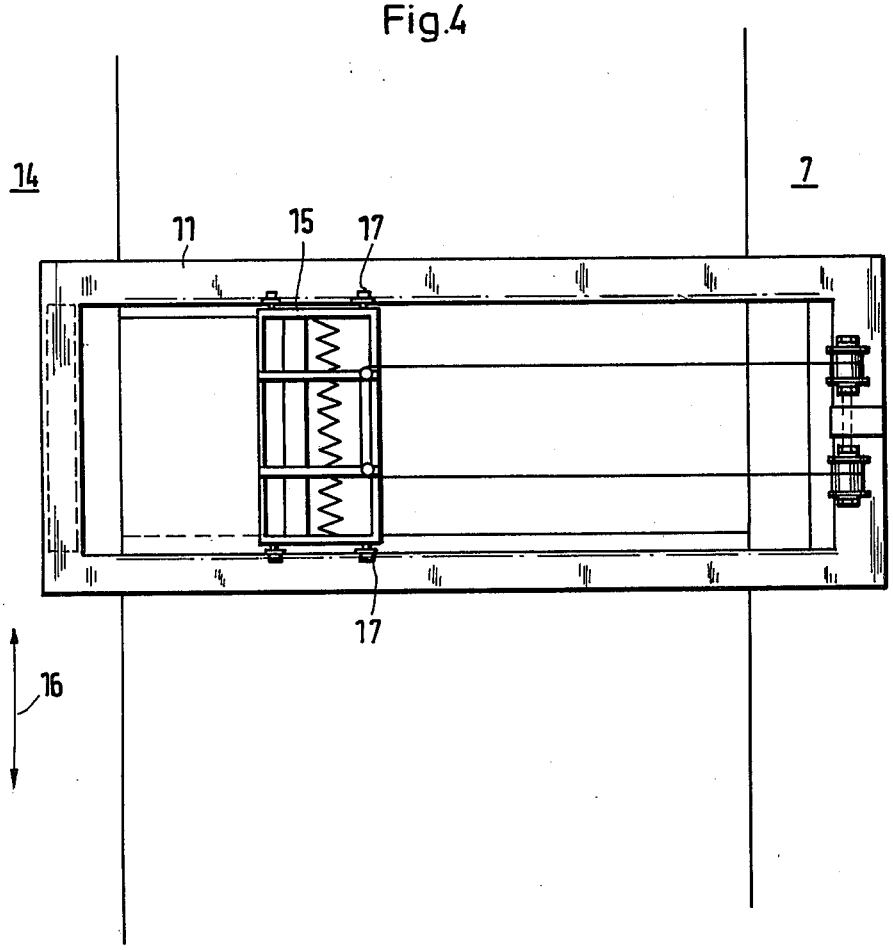
FIG. 4 is a top plan view of the machinery shown in FIG. 3.

The inventive channel construction machinery disclosed herein is designed for use on longitudinal channel construction machinery as seen in FIGS. 1 and 2 or on transverse channel construction machinery as seen in FIGS. 3 and 4. Machinery of the former type has working arms which extend transversely across the channel while the apparatus travels along the longitudinal axis of the channel. The machinery disclosed in FIGS. 3 and 4 is transverse channel construction machinery, i.e., the channel construction machinery moves transversely up and down the sloped wall embankments as it works. The present invention can be adapted for use in both longitudinal or transverse channel construction machinery.

As seen in FIG. 1, the machine frame 1 is supported on the berms 6 and 7 of the channel by means of lifting devices 2 and 3 and by means of the undercarriages 4 and 5. The levelling and lining attachment 8 is arranged so that it extends along the embankments to be worked upon. In the example shown in FIGS. 1 and 2 as well as that shown in FIGS. 3 and 4, the channel construction machinery operates alternately as an embankment levelling machine and then as an embankment lining material application machine depending on the nature of the working tool attached to the machine frame. However, it is possible to arrange both a separate levelling attachment and a separate lining attachment on the machine frame 1, each of which are constructed according to the inventive principle. This can be done by having the attachments connected to the machine frame 1 in spaced relation to one another. It is also possible to have two machine frames 1 hingedly connected together so that one follows the other and each of which is provided with a different working implement, i.e., levelling and lining attachments.

The levelling and lining attachment 8 is divided into individual embankments sections 8*a* and 8*b*, two of such embankment sections 8*a* and 8*b* making up a single embankment length 9. The division into embankment sections 8*a* and 8*b* follows the division of the arms of the frame into several individual implement carriers 10*a* and 10*b*.

In accordance with another example of the present invention, shown in FIGS. 3 and 4, the principle of the invention is employed for transverse channel construction machinery. The machine frame 11 is supported by means of the undercarriages 12 and 13 on the berm 7 and on the bottom of the channel 14. In this example, there is only one implement carrier 15. The implement carrier 15 is transversely movable with respect to the longitudinal axis of the channel 16, on wheels 17 which travel on extended frame 11.

Figure 5:
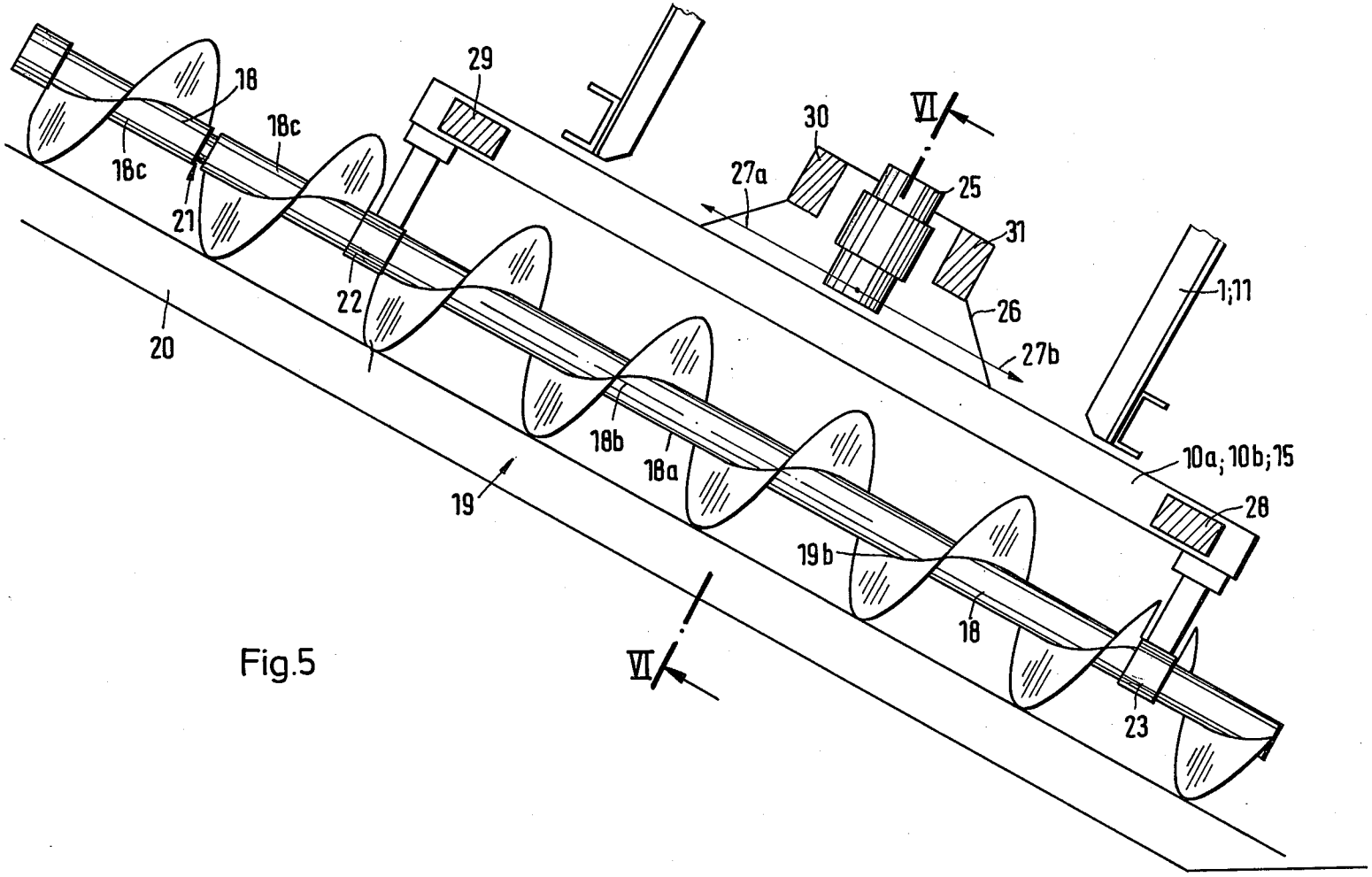
FIG. 5 is a cross sectional view, showing the shaft of the present invention with the blade-like elements.
Figure 6:
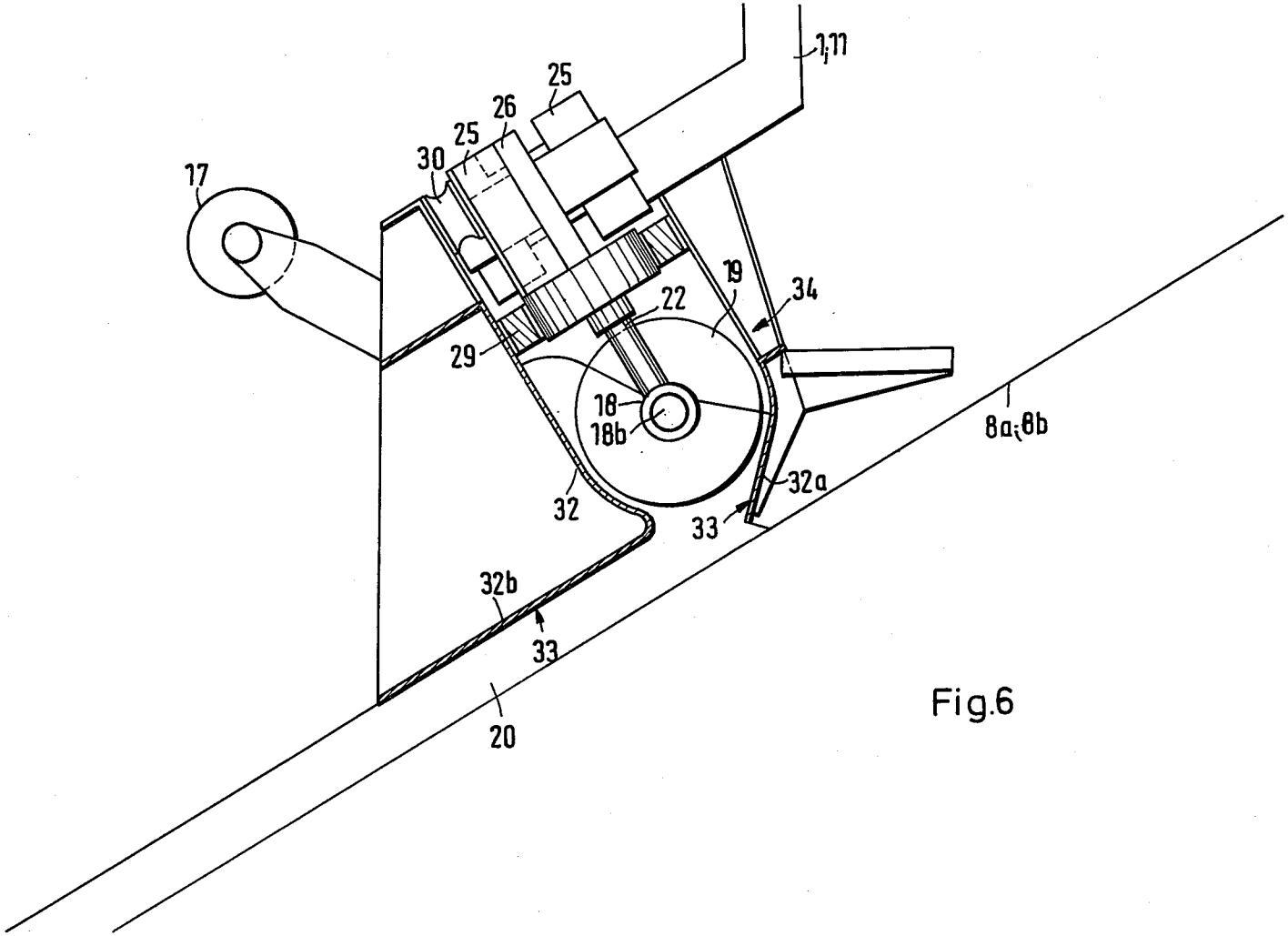
FIG. 6 is a cross sectional view taken along lines VI—VI of FIG. 5.

The longitudinal channel construction machinery (FIGS. 1 and 2) as well as the transverse channel construction machinery (FIGS. 3 and 4) are provided with rotative shafts 18 (FIGS. 5 and 6), which are proportioned to the length of an embankment section 8*a*, 8*b* or to the length of the implement carriers 10*a* and 10*b* for the apparatus of FIGS. 1 and 2 or implement carrier 15 of the apparatus of FIGS. 3 and 4. Blade-like elements 19, whose blade surfaces 19*a*, in each case, run at right angles to the axis 18*b* of the shaft 18, are attached to the outside or circumferential wall 18*a* of shaft 18. In the examples shown herein, the blade-like elements 19 are linked together and are fixedly mounted as a helix 19*b* surrounding the shaft 18. The blade-like elements 19 are angularly oriented with respect to the shaft 18 and, if desired, can be angularly adjusted with respect to the shaft. The blade-like elements 19 support and transport the thioxotropic lining material 20, which consists of fresh concrete, asphalt or the like. Thixotropic material is that material which, upon agitation becomes gel-like or liquid and, upon being left alone, will solidify.

The ends 18*c* of several shafts 18 are elastically connected together by means of couplings 21. The shafts can, however, be detached from one another, as desired for maintenance.

Each of the shafts 18 is furthermore held in pivot bearings 22 and 23. These pivot bearings 22 and 23 are attached to the implement carriers 10*a* and 10*b* for the apparatus of FIGS. 1 and 2 or to implement carrier 15 for the apparatus of FIGS. 3 and 4. For practical reasons, the distance between bearings is limited to a few meters. Several implement carriers 10*a* and 10*b* are, therefore, required for greater widths of embankments. The rotary actuators 24 (not shown) i.e., the rotative driving device for shafts 18 are located in the region of the berms 6 and 7 and certainly away from the implement carriers for the apparatus of FIGS. 1 and 2.

Vibration actuators 25 (see FIG. 6) transmit oscillatory movement to the shafts 18, which oscillation is provided to either compact the lining material 20 and/or cut the loosened bare earth material more effectively. These vibration actuators 25 transmit oscillations to the vibrating frame 26 in the directions 27*a* and 27*b* so that the shafts 18 are made to oscillate along their axial direction. Damping elements 28, 29, 30 and 31 (see FIG. 5) are incorporated, on the one hand to transfer the oscillatory movements in a particularly effective manner to the shaft 18 having the blade-like elements 19 and, on the other hand, to protect the remaining parts of the machine frame 1 or 11 against harmful mechanical oscillations. In order to substantially fix the position of the implement carriers 10*a* and 10*b* in the case of the apparatus shown in FIGS. 1 and 2 or carrier 15 in the case of the apparatus shown in FIGS. 3 and 4 in the three main axes or planes, the damping elements 28 through 31 are arranged with large distances between their bases.

During the lining process, the shaft 18, with the blade-like elements 19, applies the lining material 20, which is brought into the side walls 32*a* of the housing 32 (which walls open towards the top) over the embankment. The housing extension piece 32*b* acts as a sliding formwork 33, upon which the apparatus slides over lining material 20 for smoothing the lining material. Basically, the process is supported by the forces of gravity.

The actual compacting of lining material takes place largely through the plasticizing effect of the lining material which is produced by the vibration actuator 25 and the thixotropic lining material 20 becoming plastic-like upon agitation. In the longitudinal and transverse lining processes, the plasticizing results in a lining material pressure, which is directed downward toward the bottom of the channel 14 and which is stopped proportionally by the housing 32, as well as by the conveying effect of the blade-like elements 19. In this respect, with a relatively low side wall 32*a* acting as the front supporting wall, the inventive arrangement of the blade-like elements permits a lining material placement apparatus which is wide open towards the top and which, at the same time, is advantageous for the providing of access 34 which is required for maintenance and easy observation.

Corresponding to the arrangement of the shaft 18 with the blade-like elements 19 within the housing 32, the lining material 20 is supplied from the top into the chambers formed by the implement carriers 10*a* and 10*b* or 15 by a handling device (not shown) which is matched to the loading relationship of the channel construction machinery.

The teachings of the attached copy of the corresponding German application, upon which this application claims priority, are herein specifically incorporated by reference.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A continuous, sloped wall, channel construction machine comprising:

(a) a transportable machine frame;

(b) at least one implement carrier mounted to said machine frame;

(c) a channel working attachment secured to each of said implement carriers, said attachments selectively capable of either levelling earth on or providing material lining to the sloped walls of the channel being constructed;

(d) said attachment comprising at least one rotatable shaft;

(e) said shafts having a plurality of spaced, blade-like elements secured thereto for rotation therewith;

(f) said blade-like elements being angularly oriented with respect to said shafts and extending to a point just above the level of the sloped walls of said channel;

(g) means for rotating said shafts such that either earth material or material lining is conveyed by said attachment along the length of said shaft; and (h) an oscillation means for vibrating said shaft and said blade-like elements, said oscillation means further comprising vibration isolation means for isolating said machine frame from the vibrations produced by said oscillation means.

2. A channel construction machine as claimed in claim 1, wherein (a) the angular orientation of said blade-like elements with respect to said shaft can be adjusted.

3. A channel construction machine as claimed in claim 1, wherein said blade-like elements are a continuous helix surrounding said shaft.

4. A channel construction machine as claimed in claim 1, wherein two or more of said shafts are elastically and detachably connected together at their ends.

5. A channel construction machine as claimed in claim 1, wherein said means for rotating said shafts is connected to the end of one of said shafts and is capable of being located on the berm of the channel being constructed.

6. A channel construction machine as claimed in claim 4, wherein (a) each of said shafts are mounted on separate implement carriers, and (b) each of said implement carriers are supported on said machine frame in such a way as to be isolated from the vibrations produced by said oscillation means.

7. A channel construction machine as claimed in claim 1, wherein said oscillation means is connected between said machine frame and said implement carrier.

8. A channel construction machine as claimed in claim 1, wherein (a) said shafts and said blade-like elements are surrounded by a housing; and (b) said housing is provided with a sliding formwork extension for smoothing the lining material applied to said channel.

* * * * *